US010977896B2

(12) United States Patent
Balgooyen

(10) Patent No.: US 10,977,896 B2
(45) Date of Patent: Apr. 13, 2021

(54) DETECTING STATISTICAL ANOMALIES IN ELECTRONIC GAMING DEVICES

(71) Applicant: IGT, Las Vegas, NV (US)

(72) Inventor: Brandt Balgooyen, Las Vegas, NV (US)

(73) Assignee: IGT, Las Vegas, NV (US)

( * ) Notice: Subject to any disclaimer, the term of this patent is extended or adjusted under 35 U.S.C. 154(b) by 39 days.

(21) Appl. No.: 16/183,540

(22) Filed: Nov. 7, 2018

(65) Prior Publication Data

US 2020/0143632 A1 May 7, 2020

(51) Int. Cl.
*G07F 17/32* (2006.01)

(52) U.S. Cl.
CPC ..... *G07F 17/3244* (2013.01); *G07F 17/329* (2013.01); *G07F 17/3241* (2013.01)

(58) Field of Classification Search
CPC ..... G07F 17/3244; G07F 17/3241; G07F 17/329; G07F 17/32
See application file for complete search history.

(56) References Cited

U.S. PATENT DOCUMENTS

2006/0036874 A1 2/2006 Warner et al.
2008/0113783 A1* 5/2008 Czyzewski ..... A63F 3/00157 463/29
2013/0288785 A1* 10/2013 Arnone ..... G07F 17/3241 463/25

* cited by examiner

*Primary Examiner* — Yingchuan Zhang
(74) *Attorney, Agent, or Firm* — Sage Patent Group

(57) ABSTRACT

Operations of electronic gaming devices or other gaming devices or systems may include determining wagering data information representative of a plurality of wagers for a wagering game and calculating, based on the plurality of wagers, a t-based confidence interval that defines a range of expected hold percentages, and a predetermined percentage confidence level that is indicative of a likelihood that a calculated hold percentage for any subset of wagers including a predetermined minimum number of wagers will be within the range of expected hold percentages. Operations may also include determining whether the hold percentage for the subset of wagers is outside of the t-based confidence interval. If the hold percentage is below the lower bound of the t-based confidence interval, an anomaly alert may be transmitted that causes an alert indication to be displayed to an operator.

20 Claims, 6 Drawing Sheets

DETECTING STATISTICAL ANOMALIES IN ELECTRONIC GAMING DEVICES

BACKGROUND

Embodiments described herein relate to systems, devices, and methods for providing statistical analysis, and in particular for detecting statistical anomalies in electronic gaming devices. Electronic gaming devices include systems that allow users to place a wager on the outcome of a random event, such as the spinning of mechanical or virtual reels or wheels, the playing of virtual cards, the rolling of mechanical or virtual dice, the random placement of tiles on a screen, etc. Manufacturers of EGMs have incorporated a number of enhancements to the electronic gaming devices to allow players to interact with the electronic gaming devices in new and more engaging ways. For example, early slot machines allowed player interaction by pulling a lever or arm on the machine. As mechanical slot machines were replaced by electronic slot machines, a range of new player interface devices became available to electronic gaming device designers and were subsequently incorporated into electronic gaming devices. Examples of such interface devices include electronic buttons, wheels, and, more recently, touchscreens and three-dimensional display screens. Some types of electronic gaming devices, such as electronic table games (ETGs), combine traditional interface elements, such as a live dealer and physical table game elements, with electronic interfaces for managing wagers. As with mechanical gaming devices, cheating remains an ongoing problem with electronic gaming devices as well. There is a need for detecting and preventing cheating by players and operators of the electronic gaming devices.

BRIEF SUMMARY

According to some embodiments, a system is disclosed. The system includes a processor circuit, a communication interface, and a memory coupled to the processor circuit. The memory includes machine readable instructions that, when executed by the processor circuit, cause the processor circuit to receive wagering data for a wagering game via the communication interface. The wagering data includes information representative of a plurality of wagers including, for each wager of the plurality of wagers, a wager amount, a wager result, and a wager payout. The machine readable instructions further cause the processor circuit to calculate, based on the plurality of wagers, a t-based confidence interval that defines a range of expected hold percentages including an upper bound and a lower bound and a predetermined percentage confidence level indicative of a likelihood that a calculated hold percentage for any subset of wagers having a predetermined minimum number of wagers will be between the upper bound and the lower bound of the range of expected hold percentages. The machine readable instructions further cause the processor circuit to define a subset of wagers of the plurality of wagers including the predetermined minimum number of wagers. The machine readable instructions further cause the processor circuit to calculate a hold percentage for the subset of wagers. The machine readable instructions further cause the processor circuit to determine whether the hold percentage for the subset of wagers is below the lower bound of the t-based confidence interval. The machine readable instructions further cause the processor circuit to transmit, via the communication interface in response to determining that the hold percentage of the subset of wagers is below the lower bound of the t-based confidence interval, an anomaly alert that is associated with the subset of wagers. The anomaly alert causes an alert indication to be displayed to an operator to inform the operator that the hold percentage of the subset of wagers is below the lower bound of the t-based confidence interval.

According to some embodiments, an electronic gaming device is disclosed. The electronic gaming device includes a communication interface, a display device, a processor circuit, and a memory coupled to the processor circuit. The memory includes machine readable instructions that, when executed by the processor circuit, cause the processor circuit to receive wagering data for a wagering game via the communication interface, the wagering data including information representative of a plurality of wagers including, for each wager of the plurality of wagers, a wager amount, a wager result, and a wager payout. The machine readable instructions further cause the processor circuit to calculate, based on the plurality of wagers, a t-based confidence interval that defines a range of expected hold percentages including an upper bound and a lower bound, and a predetermined percentage confidence level indicative of a likelihood that a calculated hold percentage for any subset of wagers including a predetermined minimum number of wagers will be between the upper bound and the lower bound of the range of expected hold percentages. The machine readable instructions further cause the processor circuit to define a subset of wagers of the plurality of wagers including the predetermined minimum number of wagers. The machine readable instructions further cause the processor circuit to calculate a hold percentage for the subset of wagers. The machine readable instructions further cause the processor circuit to determine whether the hold percentage for the subset of wagers is below the lower bound of the t-based confidence interval. In response to determining that the hold percentage of the subset of wagers is below the lower bound of the t-based confidence interval, the machine readable instructions further cause the processor circuit to transmit, via the communication interface, an anomaly alert that is associated with the subset of wagers that causes the display device to display an alert indication to an operator to inform the operator that the hold percentage of the subset of wagers is below the lower bound of the t-based confidence interval.

According to some embodiments, a method for detecting statistical anomalies in a wagering game is disclosed. The method includes determining, by a processor circuit, wagering data for a wagering game, the wagering data including information representative of a plurality of wagers including, for each wager of the plurality of wagers, a wager amount, a wager result, and a wager payout. The method further includes calculating, by the processor circuit based on the plurality of wagers, a t-based confidence interval that defines a range of expected hold percentages including an upper bound and a lower bound, and a predetermined percentage confidence level indicative of a likelihood that a calculated hold percentage for any subset of wagers including a predetermined minimum number of wagers will be between the upper bound and the lower bound of the range of expected hold percentages. The method further includes defining, by the processor circuit, a subset of wagers of the plurality of wagers including the predetermined minimum number of wagers. The method further includes calculating, by the processor circuit, a hold percentage for the subset of wagers. The method further includes determining, by the processor circuit, whether the hold percentage for the subset of wagers is below the lower bound of the t-based confidence interval. The method further includes, in response to determining that the hold percentage of the subset of wagers is below the lower bound of the t-based confidence interval, transmitting, by the processor circuit via the communication interface, an anomaly alert that is associated with the subset of wagers that causes an alert indication to be displayed to an operator to inform the operator that the hold percentage of the subset of wagers is below the lower bound of the t-based confidence interval.

DETAILED DESCRIPTION

Embodiments described herein relate to systems, devices, and methods for providing statistical analysis, and in particular for detecting statistical anomalies in electronic gaming devices. In some embodiments, a processor circuit determines wagering data information representative of a plurality of wagers for a wagering game. The wagering data may include, for each wager of the plurality of wagers, a wager amount, a wager result, and a wager payout. The processor circuit calculates, based on the plurality of wagers, a t-based confidence interval that defines a range of expected hold percentages including an upper bound and a lower bound, and a predetermined percentage confidence level. The predetermined percentage confidence level is indicative of a likelihood that a calculated hold percentage for any subset of wagers including a predetermined minimum number of wagers will be between the upper bound and the lower bound of the range of expected hold percentages. The processor circuit then defines a subset of wagers that has the predetermined minimum number of wagers and calculates a hold percentage for the subset of wagers. The processor circuit determines whether the hold percentage for the subset of wagers is below the lower bound of the t-based confidence interval. In response to determining that the hold percentage of the subset of wagers is below the lower bound of the t-based confidence interval, the processor circuit transmits an anomaly alert that is associated with the subset of wagers that causes an alert indication to be displayed to an operator to inform the operator that the hold percentage of the subset of wagers is below the lower bound of the t-based confidence interval. An ongoing technical problem with operating gaming devices is the difficulty in determining whether gaming devices are operating correctly and/or are being tampered with in a way that provides an unwarranted advantage to a player. This technical problem poses a unique challenge, particularly when electronic gaming devices include a combination of live and virtual elements, because the amount of data being collected by electronic gaming devices can be difficult to manage and process. These and other embodiments provide a technical solution to this and other problems by providing statistical analysis of different subsets of wagers in real-time or near-real-time.

Figure 1:
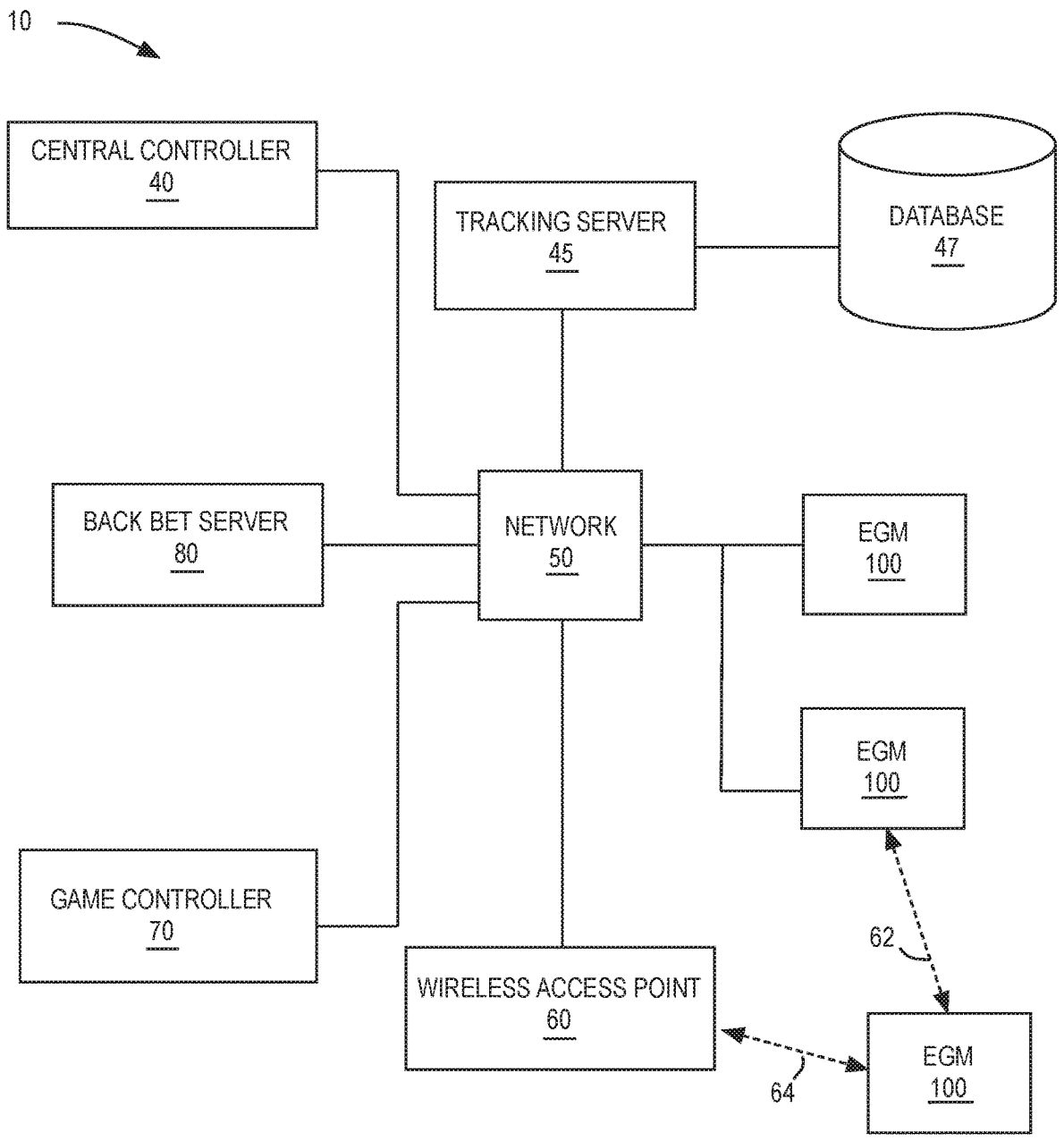
FIG. 1 is a schematic block diagram illustrating a system configuration for detecting statistical anomalies in electronic gaming devices according to some embodiments.

Electronic gaming devices may include electronic gaming machines (EGMs), electronic table games (ETGs), mobile gaming devices, or other types of devices that are usable for playing wagering games. Referring now to FIG. 1, a gaming system 10 including a plurality of electronic gaming devices 100 is illustrated. The gaming system 10 may be located, for example, on the premises of a gaming establishment, such as a casino. The electronic gaming devices 100, which may be situated on a casino floor, may be in communication with each other and/or at least one central controller 40 through a data communication network 50 or other type of network or remote communication link. The data communication network 50 may be a private data communication network that is operated, for example, by the gaming facility that operates the electronic gaming device 100. Communications over the data communication network 50 may be encrypted for security. The central controller 40 may be any suitable server or computing device which includes at least one processor circuit, which may include a processor, and at least one memory or storage device. Each electronic gaming device 100 may include a processor circuit that transmits and receives events, messages, commands or any other suitable data or signal between the electronic gaming device 100 and the central controller 40. The electronic gaming device processor circuit is operable to execute such communicated events, messages or commands in conjunction with the operation of the electronic gaming device. Moreover, the processor circuit of the central controller 40 is configured to transmit and receive events, messages, commands or any other suitable data or signal between the central controller 40 and each of the individual electronic gaming devices 100. In some embodiments, one or more of the functions of the central controller 40 may be performed by one or more electronic gaming device processor circuits. Moreover, in some embodiments, one or more of the functions of one or more electronic gaming device processor circuits as disclosed herein may be performed by the central controller 40.

A wireless access point 60 provides wireless access to the data communication network 50. The wireless access point 60 may be connected to the data communication network 50 as illustrated in FIG. 1, or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 1, the electronic gaming devices 100 of the system 10 provide primary games and/or secondary games to users of the electronic gaming devices 100. Each electronic gaming device 100 may include standalone game content, and may also communicate with one or more elements of the system 10 to provide game content to a player of the electronic gaming devices 100.

For example, in some embodiments, the electronic gaming device 100 may communicate with other components of the system 10 over a wireless interface 62, which may be a WiFi link, a Bluetooth link, an NFC link, etc. In other embodiments, the electronic gaming device 100 may communicate with the data communication network 50 (and devices connected thereto, including electronic gaming devices) over a wireless interface 64 with the wireless access point 60. The wireless interface 64 may include a WiFi link, a Bluetooth link, an NFC link, etc. In still further embodiments, the electronic gaming device 100 may communicate simultaneously with other components of the system 10 over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a WiFi link.

In some embodiments, the gaming system 10 includes a game controller 70. The game controller 70 may be a computing system that communicates through the data communication network 50 with the electronic gaming devices 100 to coordinate the provision of primary game content and/or secondary game content to one or more players using the electronic gaming devices 100. For example, the game controller 70 may manage an electronic table game (ETG) having a common dealer and/or game elements that affect multiple players of the game, such as a common dealer hand in blackjack, or a roulette spin result. The game controller 70 may be implemented within or separately from the central controller 40. In other embodiments, some or all of the operations of the wagering game may be performed within or in association with one or more mobile gaming devices that are operated by a player and/or operator.

In some embodiments, the game controller 70 may coordinate the generation and display of elements of the same primary game and/or secondary game to more than one player by more than one electronic gaming device 100. As described in more detail below, this may enable multiple players to interact with elements within the game and/or with each other in real time. This feature can be used to provide a shared multiplayer experience to multiple players at the same time. Moreover, in some embodiments, the game controller 70 may coordinate the generation and display of the same game elements to players at different electronic gaming devices 100 at a common physical location, e.g., in a common bank of electronic gaming devices 100, or at different physical locations, e.g., at different locations within a casino or at different locations at different casinos or other gaming establishments.

In some embodiments, at least some processing of game content, including images and/or objects that are provided by the electronic gaming devices 100, may be performed by the game controller 70, thereby offloading at least some processing requirements from the electronic gaming devices 100.

A back bet server 80 may be provided to manage back bets placed using an electronic gaming device 100 as described in more detail below. An electronic gaming device 100 may communicate with the back bet server 80 through the wireless interface 64 and network 50, for example.

Wagering games may involve one or more different types of bets, with each bet having predetermined odds based on a number of game rules for the wagering game. Based on these predetermined odds, a hold percentage can be calculated for each type of bet. As used herein, hold percentage refers to the percentage of wagered funds that a wagering game is statistically expected to win for an operator from a bettor over time. Hold percentage may also be referred to as house edge. For games that have a skill element, a hold percentage may be calculated based on optimal play of the game. For example, playing blackjack at a casino using "basic strategy" produces a hold percentage for the casino of approximately 0.5% over time, playing individual numbers in roulette produces a hold percentage of approximately 5.5%, and so on. In other words, for every $100 wagered, the casino is expected to earn $5 in profit, on average. With a sufficiently large sample size, an accurate actual hold percentage for a wagering game can be calculated, and it can be determined whether the actual hold percentage is consistent with an expected hold percentage.

At the same time, actual hold percentages for wagering games over short periods of time can vary dramatically, producing higher than expected profits for the operator or producing losses for the operator for smaller sample sizes. For games with high volatility, these variances in wins and losses may be more pronounced. As a result, it can be difficult to determine whether an actual hold percentage for a wagering game is consistent with an expected hold percentage using smaller sample sizes.

With the introduction of electronic table games (ETGs), a large amount of data can now be collected, analyzed, and accounted for by systems associated with the ETG. For example, bet amount information, payout amount information, time information, and/or location information for every bet that is placed at an electronic roulette table may be collected and stored, which allows different subsets of bets to be grouped and analyzed independently. For example, if a player is cheating and betting large amounts to maximize his winnings, the actual hold percentage for higher bet amounts may be significantly lower than the actual hold percentage for lower bet amounts. The actual hold percentage for higher bet amounts may also be significantly lower than the expected hold percentage for bets of that type. By analyzing different subsets of bets, an operator can detect anomalies more quickly, more efficiently, and on a more granular level in real-time or near-real-time.

One way an operator can detect anomalies is by calculating a t-based confidence interval for a plurality of wagers, which defines a range of expected hold percentages and a confidence level. The range of expected hold percentages has an upper bound and lower bound, and may be based on the expected odds for the plurality of wagers. The confidence level indicates a likelihood (e.g., a percentage likelihood) that an actual calculated hold percentage for the actual wagers will be between the upper bound and the lower bound, provided that the number of wagers constitutes a sufficiently large sample size. For example, a confidence interval having confidence level of 95% for a group of wagers, which may also be referred to as a 95% t-based confidence interval, means that there is a 95% chance that the actual hold percentage for the actual wagers will be within the range of expected hold percentages. Similarly, a 99% t-based confidence interval means that there is a 99% chance that the actual hold percentage will be within the expected range, etc. If the actual hold percentage is outside the range of expected hold percentages, however, this may represent an anomaly that may warrant additional investigation.

For example, for an electronic roulette game, a 99% t-based confidence interval may indicate that there is a 99% chance that the individual number bets will have a hold percentage between 30.5% and −19.5%. In other words, 99% of the time, the game should be earning no more than $30.50 for every $100 wagered, and should be earning no less than −$19.50 (i.e., losing no more than $19.50) for every $100 wagered. If the roulette game is earning more than $30.50 or losing more than $19.50 for every $100 wagered, then this represents an anomaly and is a strong indication that the game is not operating correctly.

In some examples, thousands of individual bets may be placed at a particular table game in a day of operation. Because so much information can be collected for each wager, it is possible to group the wagers into subsets that are still sufficiently large to produce statistically significant results. For example, an overall hold percentage for a table game may be within a 99% t-based confidence interval, but a casino operator may want to know if wagers above a certain amount are performing differently than expected. If the hold percentage for large wagers is lower than the lower bound of the 99% t-based confidence interval, for example, this may indicate that cheating is occurring and that the cheating individuals are placing large bets to take advantage of their unwarranted edge.

Figure 2:
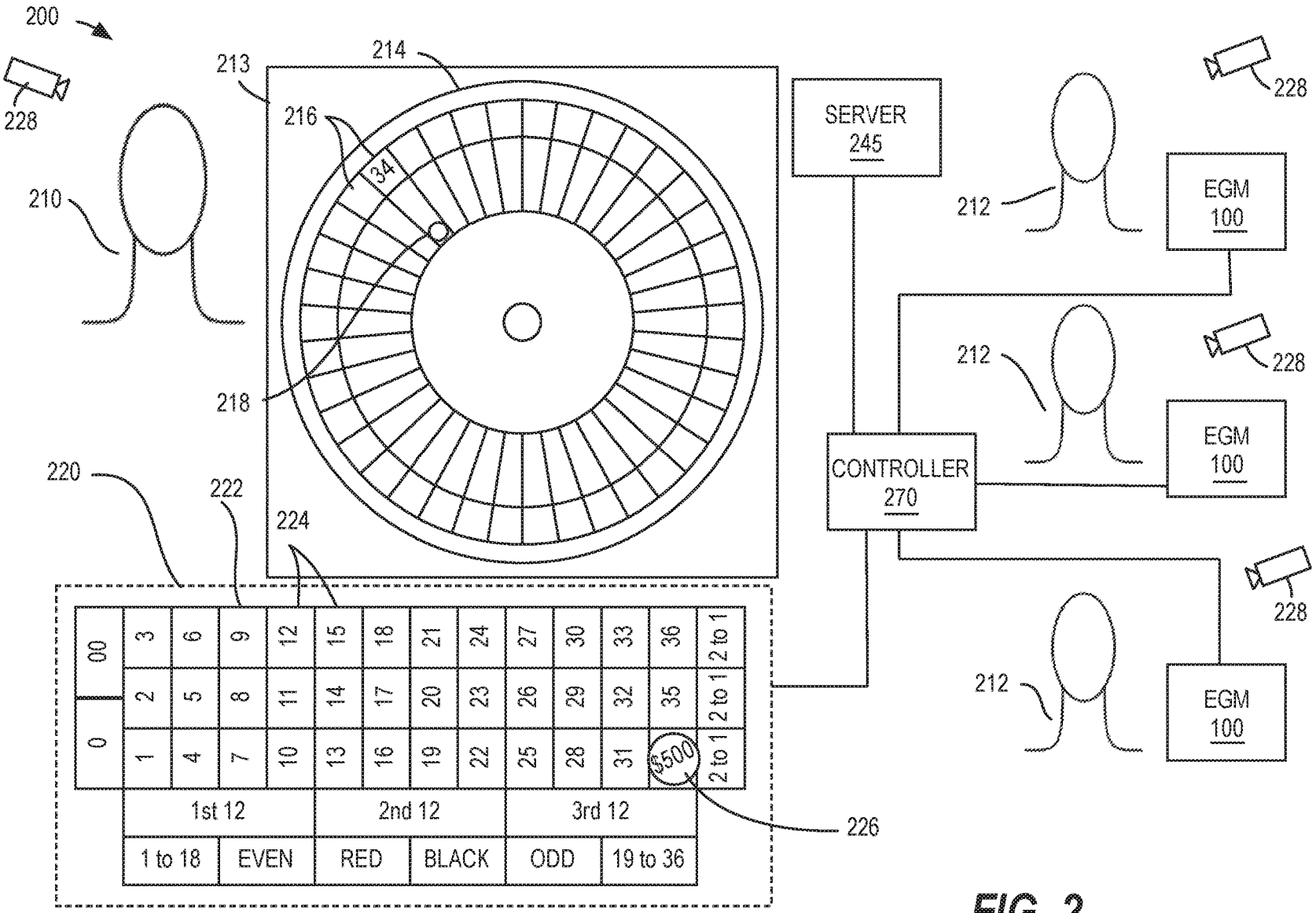
FIG. 2 is a diagram of an electronic table game illustrating how statistical anomalies caused by a cheating player and/or operator may be detected according to some embodiments.

Referring now to FIG. 2, a system 200 for providing an electronic table game, which is a roulette game in this embodiment, is illustrated. It should be understood, however, that embodiments are not limited to electronic table games, and may include EGMs or other types of electronic gaming devices, mobile gaming devices, and/or combinations thereof. The system 200 in this example includes a game controller 270 similar to the game controller 70 of FIG. 1, and may include additional components similar to the components of FIG. 1, such as a player tracking server 245 or other type of server, for example. In this embodiment, a live dealer 210 runs the game, and a plurality of players 212 play the game via respective electronic gaming devices 100. As noted above, the players 212 and dealer 210 may all be in a common location, or the players 212 may be located remotely from the dealer 210 and/or from each other. In this embodiment, the dealer 210 at a physical game table 213 spins a physical roulette wheel 214 having a plurality of number positions 216 and a ball 218, which drops into one of the number positions 216 to produce a game result. It should be understood, however, that additional or other table game elements may be used for different types of games, with different arrangements of table game elements (e.g., roulette ball positions, hands of cards, dice rolls, etc.) determining different game results. Each player 212 places one or more wagers through a graphical user interface (GUI) 220 managed by the game controller 270. The GUI 220 includes a virtual betting area 222 having a plurality of number positions 224 and other areas for different wagers. In this example, a player 212 has placed a $500 wager 226 on number 34, and the ball 218 has landed on position number 34 on the roulette wheel 214, indicating a winning result. The dealer 210 inputs an indication of the game result, which causes the game controller 270 to resolve the wagers associated with the result. Security cameras 228 monitor the dealer 210 and the players 212 and may generate time-stamped footage correlated to particular betting activities by the dealer 210 and/or the players 212.

Over time, the system 200 may detect an anomaly, i.e., an indication that a plurality of wagers and/or a subset of wagers meeting certain criteria are outside a predetermined t-based confidence interval. In this event, the system 200 may notify an operator of the system 200 of the anomaly, and may also access surveillance information, such as time-stamped recordings from the security cameras 228 corresponding to the bets placed by particular players 212 and/or with a particular dealer 210.

In this example, 2000 wagers are placed over the course of a day, 50 of which (i.e., 2.5%) are for $500 or more, including the wager 226. In this example, the roulette dealer 210 is colluding with one of the players 212 to ensure that the roulette ball lands on the player's number (i.e., number 34). The cheating player 212 places large bets of $500 or more, and the roulette dealer 210 tampers with the physical roulette wheel 214 and/or ball 218 to cause the ball 218 to land on the cheating player's number 216. If the cheating player 212 and dealer 210 are careful, this behavior may be difficult to detect using conventional casino surveillance. However, by comparing the actual hold percentages for the roulette game to a 99% t-based confidence interval for the game, anomalies may be detected, which may provide clues for detecting and stopping the cheating activity that may not be immediately apparent based on conventional casino surveillance alone.

For the electronic roulette game in this example, the 99% t-based confidence interval indicates that 99% of the individual number bets should have a hold percentage between 30.5% and −19.5%. If the calculated hold percentage for the 2000 wagers is outside the confidence interval, i.e., indicating a loss of more than 19.5%, this may be an indication that the game is not operating properly. Even if the calculated hold percentage for the 2000 wagers is within the confidence interval, a separate hold percentage can be calculated for the 50 wagers that were for $500 or more. For these wagers, the calculated hold percentage may be outside the confidence interval, i.e., indicating a loss of more than 19.5%, which may provide another indication that the game is not operating properly.

Once the anomaly has been detected, the operator has several options at its disposal to address the issue. Because each bet may have an associated time stamp, location, and/or player position, the operator can refer to surveillance footage and/or employ other security measures that can help identify the individuals associated with the anomaly. In this example, by examining the surveillance footage associated with the 50 wagers above $500, the operator can quickly and efficiently determine that a significant portion of those wagers were placed by a particular player 212 and/or resolved by a particular roulette dealer 210. Further examination can allow the operator to determine that the roulette dealer 210 has been interfering with the roulette wheel 214 and/or ball 218 at the same time that the particular player 212 places large wagers 226.

In some embodiments, the system 200 may communicate directly with components of the surveillance system, such as the security cameras 228, to collect and make available surveillance footage associated with the subset of bets that produced the anomaly. In some examples, the system 200 may also be automated to routinely and/or iteratively compare subsets of wagers with a t-based confidence interval for those wagers over time. When an anomaly is detected, an alert or notification may be generated, which may then be stored and/or provided to an operator for further analysis and/or action.

It should be understood that other types of data collection methods, tools, devices and/or systems may be used. Aggregated data may include number of transactions, total amount wagered (e.g., coin in), and total amount paid (e.g., gross win). Subsets of wagers may be determined based on bet level (e.g., denominations and/or multiples thereof), and may be updated in real time. Different anomaly thresholds may also be determined based on different criteria, such as player and/or dealer identity, time of day, day of the week, etc.

Figure 3A:
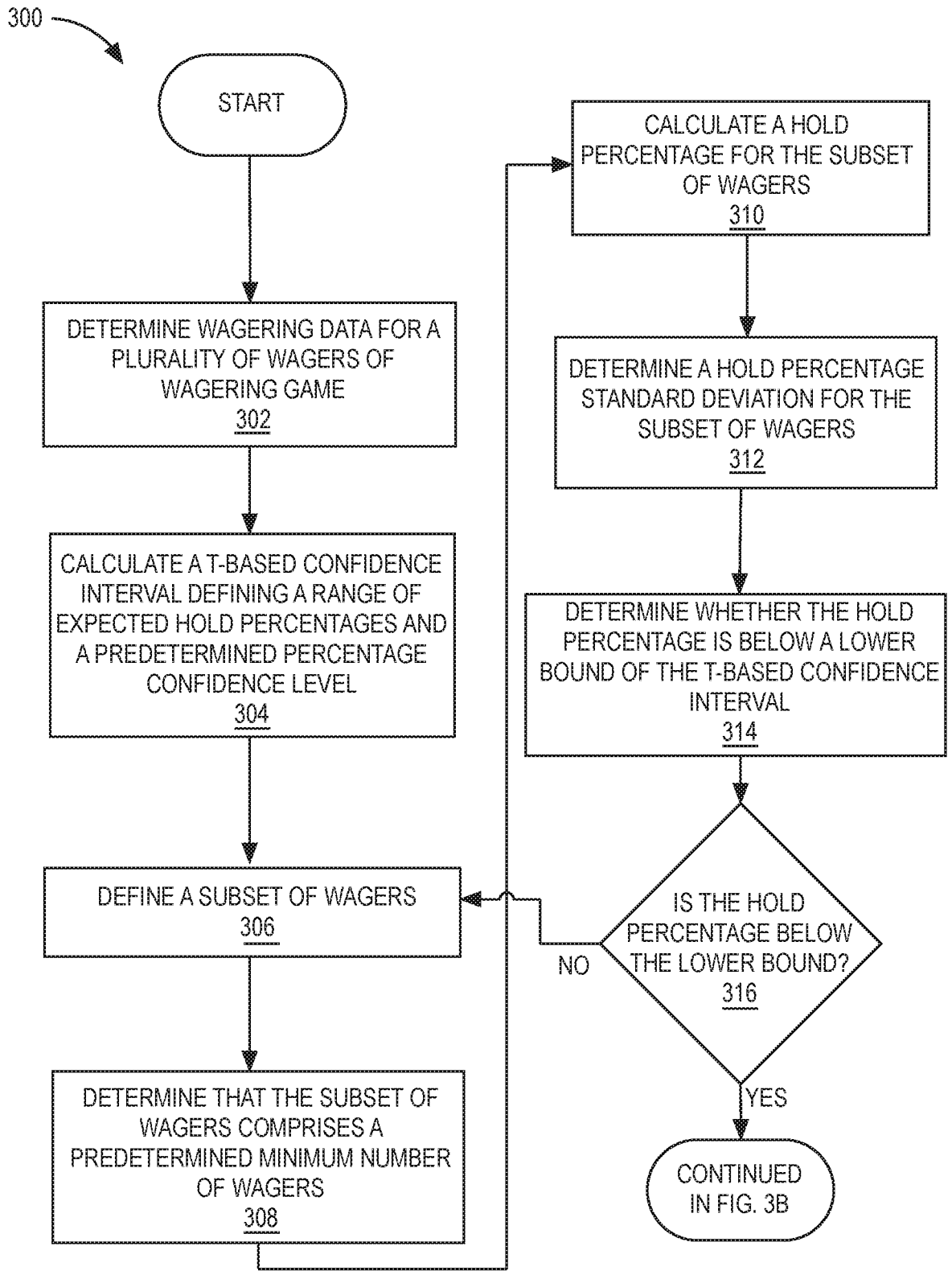
FIGS. 3A and 3B are flowcharts illustrating operations of systems/methods according to some embodiments.
Figure 3B:
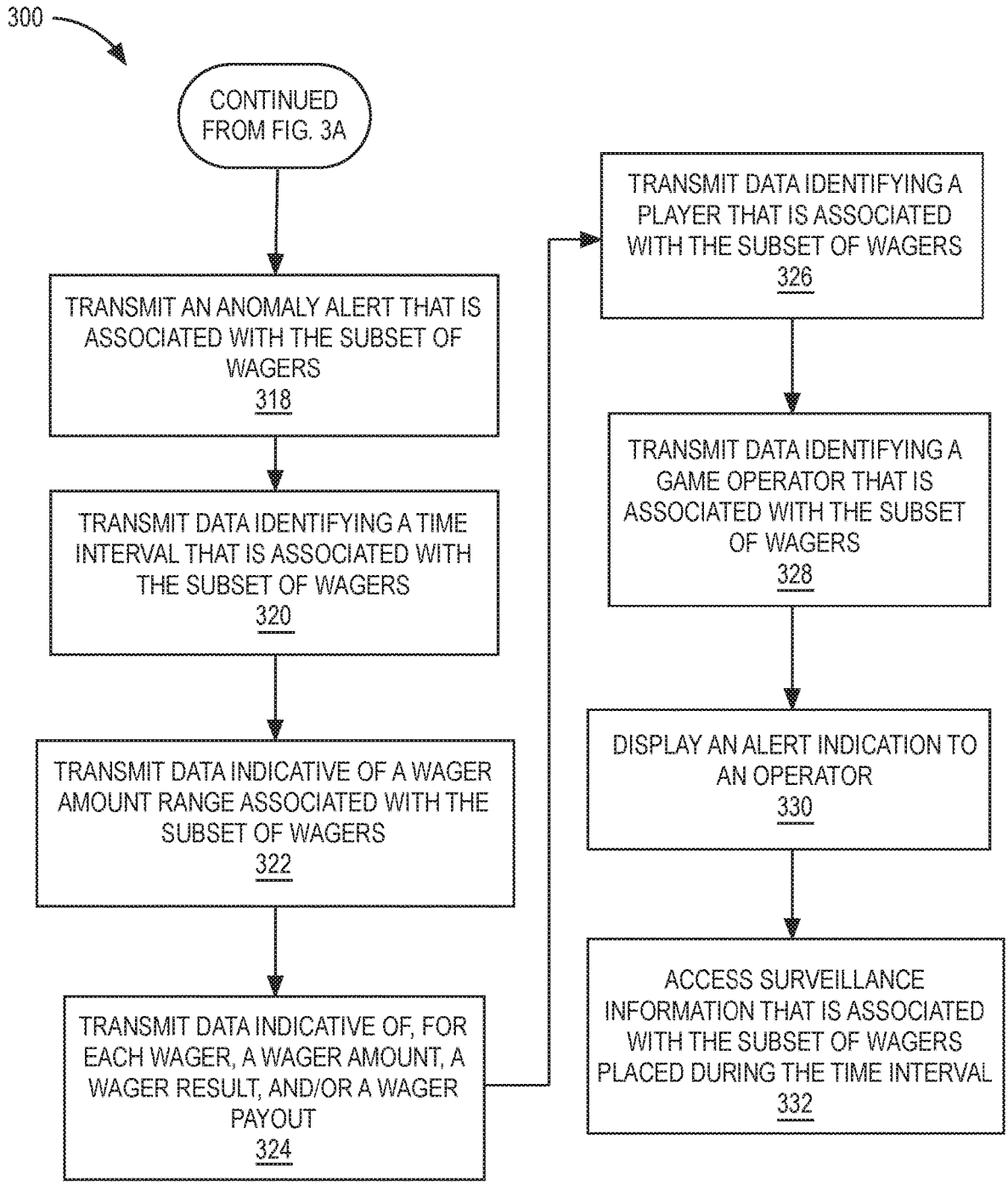

Referring now to FIGS. 3A and 3B, a flowchart illustrating operations of systems/methods according to some embodiments is illustrated. The operations 300 of FIGS. 3A and 3B may include determining wagering data for a plurality of wagers of a wagering game (Block 302). For example, the wagering data may include information representative of a plurality of wagers including, for each wager of the plurality of wagers, a wager amount, a wager result, and a wager payout. The operations 300 may further include calculating a t-based confidence interval defining a range of expected hold percentages having an upper bound and a lower bound, and a predetermined percentage confidence level (Block 304). The predetermined confidence level is indicative of a likelihood that a calculated hold percentage for any subset of wagers having a predetermined minimum number of wagers will be between the upper bound and the lower bound of the range of expected hold percentages. The operations 300 may further include defining a subset of wagers (Block 306) and determining that the subset of wagers includes at least a predetermined minimum number of wagers (Block 308), so that the subset of wagers may produce statistically significant results. The operations 300 may further include calculating a hold percentage for the subset of wagers (Block 310), and may also include determining a hold percentage standard deviation for the subset of wagers (Block 312). Determining the hold percentage standard deviation may include calculating the hold percentage standard deviation based on the underlying game math for the wagering game, or estimating the hold percentage standard deviation based on the wagering data or other data, for example. The operations 300 may further include determining whether the hold percentage is below a lower bound of the t-based confidence interval (Blocks 314 and 316). If the hold percentage is not below the lower bound, the operations 300 may return to Block 306 and a new subset of wagers may be defined. Alternatively or in addition, the operations may generate and/or transmit a report that the game is operating normally if the hold percentage is not below the lower bound.

Referring now to FIG. 3B, if the hold percentage is below the lower bound, the operations 300 may include transmitting an anomaly alert that is associated with the subset of wagers (Block 318). The operations 300 may also include transmitting data identifying a time interval that is associated with the subset of wagers (Block 320), transmitting data indicative of a wager amount range associated with the subset of wagers (Block 322), and/or transmitting data indicative of, for each wager, a wager amount, a wager result, and/or a wager payout (Block 324). The operations 300 may also include transmitting data identifying a player (Block 326) and/or a game operator (such as a dealer) (Block 328) that is associated with the subset of wagers. The operations 300 may further include displaying an alert indication to an operator (Block 330), who may be the game operator, or another operator. The operations 300 may further include accessing surveillance information that is associated with the subset of wagers placed during the time interval (Block 332). It should be understood that in these and other embodiments, any number of math parameters or statistical parameters, including ranges of expected hold percentages, may be used to determine whether a game is operating properly, and according to expected mathematical functions. Verification that the game is operating properly has a number of advantages, including facilitating positive relationships between customers and operators, for example.

Figure 4:
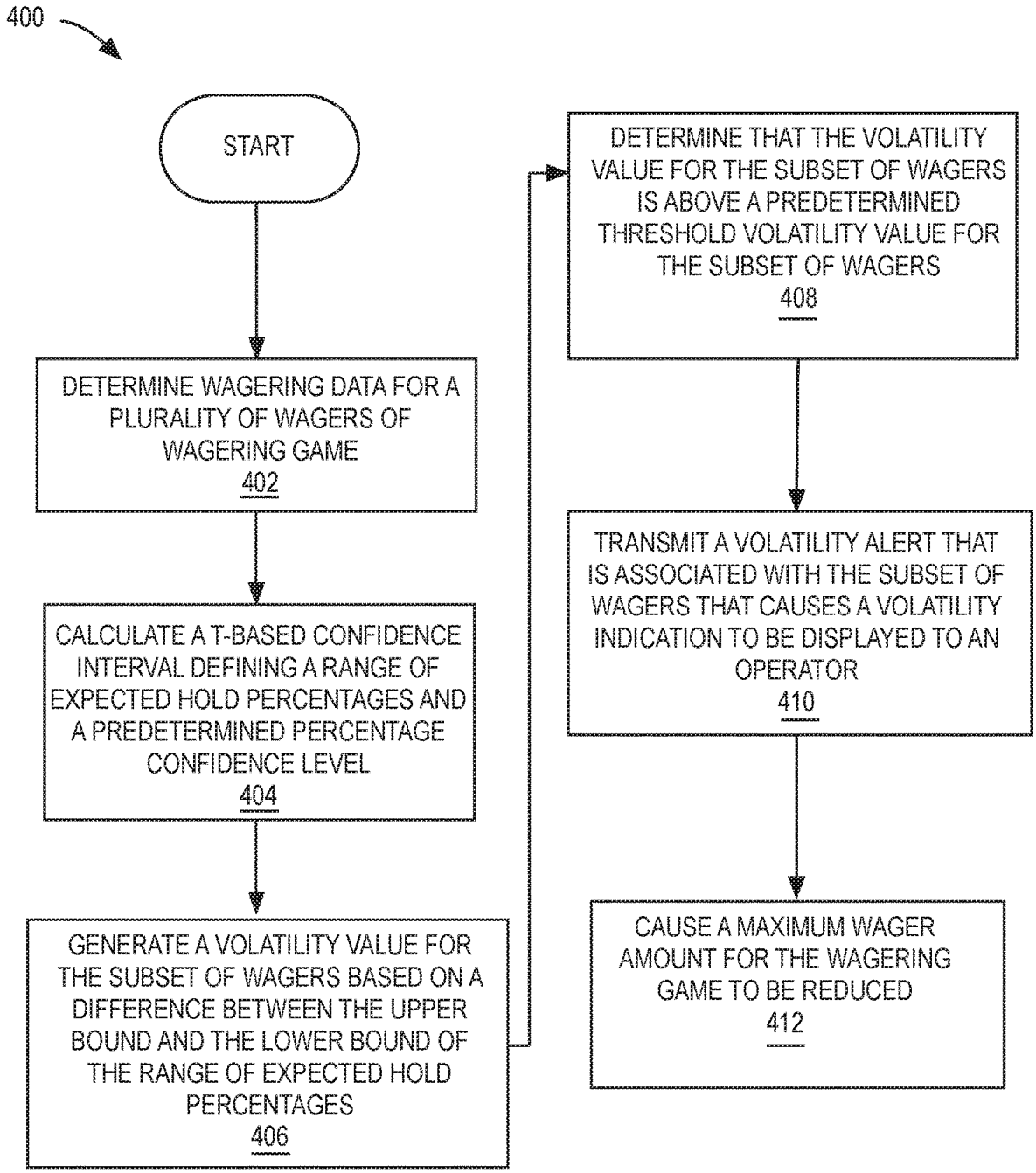
FIG. 4 is a flowchart illustrating operations of systems/methods according to some embodiments.

Referring now to FIG. 4, a flowchart illustrating operations of systems/methods according to some embodiments is illustrated. The operations 400 of FIG. 4 may include determining wagering data for a plurality of wagers of a wagering game (Block 402), and calculating a t-based confidence interval defining a range of expected hold percentages having an upper bound and a lower bound, and a predetermined percentage confidence level (Block 404). The operations 400 may further include generating a volatility value for the subset of wagers based on a difference between the upper bound and the lower bound of the range of expected hold percentages (Block 406). The volatility value is indicative of short-term risk associated with particular wagers. For example, while a casino game may produce a mean expected hold percentage over time, a high volatility value may indicate that the short term risk of a large loss by the casino may be unacceptably high, and the operator may want the option of reducing wagering limits for bets that have an unacceptably high level of volatility. These and other features may also be used to determine and/or indicate an optimal denomination range based on a variety of parameters, including volatility values, expected hold percentages, and other values for reducing risk of loss based on expected statistical results for the wagering game.

To address this issue, if the operations 400 may determine that the volatility value for the subset of wagers is above a predetermined threshold volatility value for the subset of wagers (Block 408), the operations 400 may include transmitting a volatility alert that is associated with the subset of wagers that causes a volatility indication to be displayed to an operator (Block 410). The operations 400 may also include causing a maximum wager amount of the wagering game to be reduced (Block 412). Alternatively or in addition, operations may include determining an optimal range of wager amounts for the wagering game and transmitting an indication of the optimal range of wager amounts to the operator.

Figure 5:
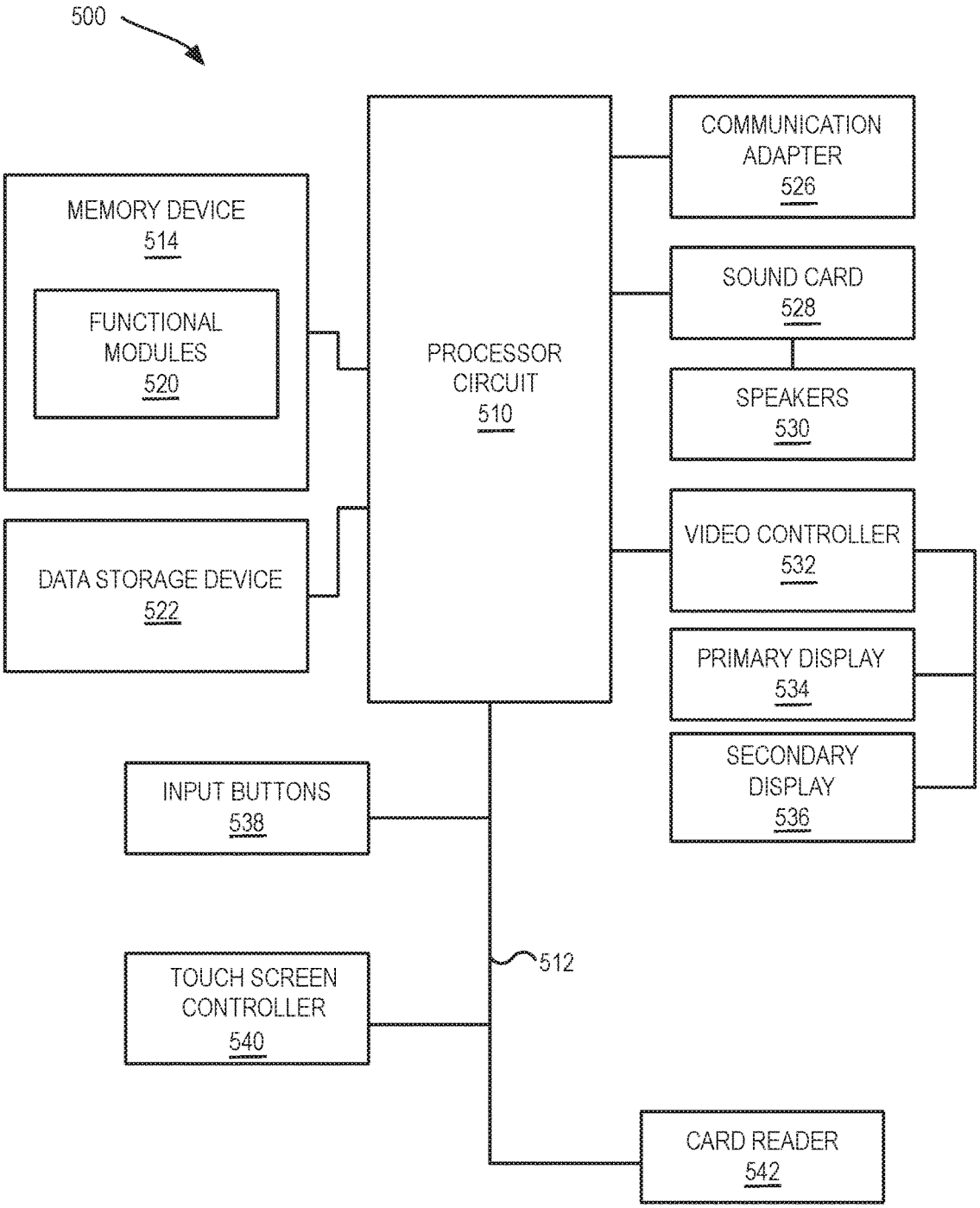
FIG. 5 is a block diagram of components of a computing device similar to the computing devices and components of FIG. 1, according to some embodiments.

FIG. 5 is a block diagram of components of a computing device 500 similar to the computing devices and components of FIG. 1, according to some embodiments. The computing device 500 of FIG. 5 and/or components thereof may be suitable for use as or in connection with various components of the devices, systems and methods described herein. As shown in FIG. 5, the computing device 500 may include a processor circuit 510, or processor circuit, that controls operations of the computing device 500. Although illustrated as a single processor circuit, multiple special purpose and/or general purpose processor circuits and/or processor circuit cores may be provided in the computing device 500. For example, the computing device 500 may include one or more of a video processor circuit, a signal processor circuit, a sound processor circuit and/or a communication controller that performs one or more control functions within the computing device 500. The processor circuit 510 may include and/or may be included in various components, which may be variously referred to as a "controller," "microcontroller," "microprocessor" or simply a "computer," for example. The processor circuit may further include one or more application-specific integrated circuits (ASICs).

Various components of the computing device 500 are illustrated in FIG. 5 as being connected to the processor circuit 510. It will be appreciated that the components may be connected to the processor circuit 510 through a system bus 512, a communication bus and controller, such as a USB controller and USB bus, a network interface, or any other suitable type of connection.

The computing device 500 further includes a memory device 514 that stores one or more functional modules 520 for performing the operations described above. The memory device 514 may store machine readable instructions, such as program code for example, executable by the processor circuit 510, to control the computing device 500. The memory device 514 may include random access memory (RAM), which can include non-volatile RAM (NVRAM), magnetic RAM (ARAM), ferroelectric RAM (FeRAM) and other forms as commonly understood in the gaming industry. In some embodiments, the memory device 514 may include read only memory (ROM). In some embodiments, the memory device 514 may include flash memory and/or EEPROM (electrically erasable programmable read only memory). Any other suitable magnetic, optical and/or semiconductor memory may operate in conjunction with the gaming device disclosed herein.

The computing device 500 may further include a data storage device 522, such as a hard disk drive or flash memory. The data storage device 522 may store program data, player data, audit trail data or any other type of data. The data storage device 522 may include a detachable or removable memory device, including, but not limited to, a suitable cartridge, disk, CD ROM, DVD or USB memory device.

The computing device 500 may include a communication adapter 526 that enables the computing device 500 to communicate with remote devices over a wired and/or wireless communication network, such as a local area network (LAN), wide area network (WAN), cellular communication network, or other data communication network. The communication adapter 526 may further include circuitry for supporting short range wireless communication protocols, such as Bluetooth and/or near field communications (NFC) that enable the computing device 500 to communicate, for example, with a mobile communication device operated by a player.

The computing device 500 may include one or more internal or external communication ports that enable the processor circuit 510 to communicate with and to operate with internal or external peripheral devices, such as a sound card 528 connected to speakers 530, a video controller 532 connected to a primary display 534 and/or a secondary display 536, input buttons 538, a touch screen controller 540, or a card reader 542, for example. Additional internal or external peripheral devices that may be used include eye tracking devices, position tracking devices, cameras, accelerometers, arcade sticks, bar code readers, bill validators, biometric input devices, button panels, card readers, currency acceptors and dispensers, additional displays or video sources, expansion buses, information panels, keypads, lights, mass storage devices, microphones, motion sensors, motors, printers, reels, SCSI ports, solenoids, speakers, thumb drives, ticket readers, trackballs, touchpads, wheels, and wireless communication devices. In some embodiments, internal or external peripheral devices may communicate with the processor circuit through a universal serial bus (USB) hub (not shown) connected to the processor circuit 510.

The present disclosure contemplates a variety of different systems and/or devices, each having one or more of a plurality of different features, attributes, or characteristics. In certain such embodiments, computerized instructions for controlling any features or content displayed by the display devices or other devices are executed by the central server, central controller, or remote host. In such "thin client" embodiments, the central server, central controller, or remote host remotely controls any games (or other suitable interfaces) displayed by the device, and the device is utilized to display such features (or other suitable interfaces) and to receive one or more inputs or commands. In other such embodiments, computerized instructions for controlling any features displayed by the device are communicated from the central server, central controller, and/or remote host to the device and are stored in at least one memory device of the device. In such "thick client" embodiments, the processor circuit of the device executes the computerized instructions to control any games (or other suitable interfaces) displayed by the device.

In some embodiments in which the system may include: (a) a device configured to communicate with a central server, central controller, or remote host through a data network; and/or (b) a plurality of devices configured to communicate with one another through a data network, the data network is an internet or an intranet. In these and other embodiments, an internet browser of the device is usable to access an internet game page from any location where an internet connection is available. In one such embodiment, after the internet content page is accessed, the central server, central controller, or remote host identifies a user prior to enabling that user to use particular features. In one example, the central server, central controller, or remote host identifies the user by determining that the user is logged into a user account via an input of a unique username and password combination assigned to the user. It should be appreciated, however, that the central server, central controller, and/or remote host may identify the user in any other suitable manner, such as by validating a user tracking identification number associated with the user; by reading a user tracking card or other smart card inserted into a card reader (as described below); by validating a unique user identification number associated with the user by the central server, central controller, and/or remote host; or by identifying the device, such as by identifying the MAC address or the IP address of the internet facilitator. In various embodiments, once the central server, central controller, and/or remote host identifies the user, the central server, central controller, and/or remote host enables features and/or content, and displays the features and/or content via the internet browser of the electronic gaming device.

It should be appreciated that the central server, central controller, and/or remote host and the device(s) are configured to connect to the data network or remote communications link in any suitable manner. In various embodiments, such a connection may be accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of devices from an ever-increasing quantity of remote sites. It should also be appreciated that the enhanced bandwidth of digital wireless communications may render such technology suitable for some or all communications, such as encrypted communications, for example. Higher data transmission speeds may be useful for enhancing the sophistication and response of the display and interaction with users.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more machine readable media having machine readable instructions, such as computer readable media having computer readable program code for example, embodied thereon.

Any combination of one or more machine readable media may be utilized. The machine readable media may be a machine readable signal medium or a machine readable storage medium. A machine readable storage medium may be, for example, but not limited to, an electronic, magnetic, optical, electromagnetic, or semiconductor system, apparatus, or device, or any suitable combination of the foregoing. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a machine readable storage medium may be any medium that can contain, or store a program for use by or in connection with an instruction execution system, apparatus, or device.

A machine readable signal medium may include a propagated data signal with machine readable instructions embodied therein, for example, in baseband or as part of a carrier wave. Such a propagated signal may take any of a variety of forms, including, but not limited to, electro-magnetic, optical, or any suitable combination thereof. A machine readable signal medium may be any machine readable medium that is not a machine readable storage medium and that can communicate, propagate, or transport a program for use by or in connection with an instruction execution system, apparatus, or device. Instructions embodied on a machine readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a machine readable medium that when executed can direct a computer, other programmable data processing apparatus, or other devices to function in a particular manner, such that the instructions when stored in the machine readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well and may be interpreted as "one or more", unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A system comprising:

a processor circuit;

a communication interface; and a memory coupled to the processor circuit, the memory comprising machine readable instructions that, when executed by the processor circuit:

cause the processor circuit to receive wagering data for a wagering game via the communication interface, the wagering data comprising information representative of a plurality of wagers comprising, for each wager of the plurality of wagers, a wager amount, a wager result, and a wager payout;

cause the processor circuit to calculate, based on the plurality of wagers, a t-based confidence interval that defines:

a range of expected hold percentages comprising an upper bound and a lower bound; and a predetermined percentage confidence level indicative of a likelihood that a calculated hold percentage for any subset of wagers comprising a predetermined minimum number of wagers will be between the upper bound and the lower bound of the range of expected hold percentages;

cause the processor circuit to define a subset of wagers of the plurality of wagers comprising the predetermined minimum number of wagers;

cause the processor circuit to calculate a hold percentage for the subset of wagers;

cause the processor circuit to determine whether the hold percentage for the subset of wagers is below the lower bound of the t-based confidence interval; and cause the processor circuit to transmit, via the communication interface in response to determining that the hold percentage of the subset of wagers is below the lower bound of the t-based confidence interval, an anomaly alert that is associated with the subset of wagers that causes an alert indication to be displayed to an operator to inform the operator that the hold percentage of the subset of wagers is below the lower bound of the t-based confidence interval.

2. The system of claim 1, wherein the predetermined percentage confidence level is a 99% confidence level indicative of a 99% likelihood that a calculated hold percentage for any subset of wagers comprising the predetermined minimum number of wagers will be between the upper bound and the lower bound of the range of expected hold percentages.

3. The system of claim 1, wherein the machine readable instructions that cause the processor circuit to calculate a hold percentage for the subset of wagers further comprise machine readable instructions that cause the processor circuit to determine a hold percentage standard deviation for the subset of wagers.

4. The system of claim 1, wherein the machine readable instructions that cause the processor circuit to transmit the anomaly alert that is associated with the subset of wagers further comprise machine readable instructions that cause the processor circuit to transmit data identifying a time interval that is associated with the subset of wagers.

5. The system of claim 4, the memory further comprising machine readable instructions that cause the processor circuit to, in response to determining that the hold percentage of the subset of wagers is below the lower bound of the t-based confidence interval, access surveillance information that is associated with the subset of wagers placed during the time interval.

6. The system of claim 1, wherein the machine readable instructions that cause the processor circuit to transmit the anomaly alert that is associated with the subset of wagers further comprise machine readable instructions that cause the processor circuit to transmit data identifying a player that is associated with the subset of wagers.

7. The system of claim 1, wherein machine readable instructions that cause the processor circuit to transmit the anomaly alert that is associated with the subset of wagers further comprise machine readable instructions that cause the processor circuit to transmit data identifying a game operator that is associated with the subset of wagers.

8. The system of claim 1, wherein the machine readable instructions that cause the processor circuit to transmit the anomaly alert that is associated with the subset of wagers further comprise machine readable instructions that cause the processor circuit to transmit data indicative of a wager amount range associated with the subset of wagers.

9. The system of claim 1, wherein the machine readable instructions that cause the processor circuit to transmit the anomaly alert that is associated with the subset of wagers further comprises machine readable instructions that cause the processor circuit to transmit data comprising, for each wager of the subset of wagers, a wager amount, a wager result, and a wager payout.

10. The system of claim 1, the memory further comprising machine readable instructions that cause the processor circuit to, prior to calculating the hold percentage for the subset of wagers, determine that the subset of wagers comprises the predetermined minimum number of wagers.

11. The system of claim 1, the memory further comprising machine readable instructions that cause the processor circuit to generate, by the processor circuit, a volatility value for the subset of wagers based on a difference between the upper bound and the lower bound of the range of expected hold percentages.

12. The system of claim 11, the memory further comprising machine readable instructions that cause the processor circuit to:

determine whether the volatility value for the subset of wagers is above a predetermined threshold volatility value for the subset of wagers; and in response to determining that the volatility value for the subset of wagers is above the predetermined threshold volatility value, transmit, via the communication interface, a volatility alert that is associated with the subset of wagers that causes a volatility indication to be displayed to an operator to inform the operator that the volatility value for the subset of wagers is above the predetermined threshold volatility value.

13. The system of claim 12, wherein the machine readable instructions that cause the processor circuit to transmit the volatility alert further comprise machine readable instructions that cause the processor circuit to cause a maximum wager amount for the wagering game to be reduced.

14. The system of claim 12, the memory further comprising machine readable instructions that cause the processor circuit to:

determine an optimal range of wager amounts for the wagering game; and transmit, via the communication interface, an indication of the optimal range of wager amounts to the operator.

15. The system of claim 1, further comprising:

a game table comprising a plurality of table game elements, wherein the memory further comprises machine readable instructions that cause the processor circuit to:

receive an input from a game operator indicative of a game result based on an arrangement of the plurality of table game elements and a game rule; and based on the input, determine the wager result for a particular wager of the plurality of wagers.

16. An electronic gaming device comprising:

a communication interface;

a display device;

a processor circuit; and a memory coupled to the processor circuit, the memory comprising machine readable instructions that, when executed by the processor circuit:

cause the processor circuit to receive wagering data for a wagering game via the communication interface, the wagering data comprising information representative of a plurality of wagers comprising, for each wager of the plurality of wagers, a wager amount, a wager result, and a wager payout;

cause the processor circuit to calculate, based on the plurality of wagers, a t-based confidence interval that defines:

a range of expected hold percentages comprising an upper bound and a lower bound; and a predetermined percentage confidence level indicative of a likelihood that a calculated hold percentage for any subset of wagers comprising a predetermined minimum number of wagers will be between the upper bound and the lower bound of the range of expected hold percentages;

cause the processor circuit to define a subset of wagers of the plurality of wagers comprising the predetermined minimum number of wagers;

cause the processor circuit to calculate a hold percentage for the subset of wagers;

cause the processor circuit to determine whether the hold percentage for the subset of wagers is below the lower bound of the t-based confidence interval; and in response to determining that the hold percentage of the subset of wagers is below the lower bound of the t-based confidence interval, cause the processor circuit to transmit, via the communication interface, an anomaly alert that is associated with the subset of wagers that causes the display device to display an alert indication to an operator to inform the operator that the hold percentage of the subset of wagers is below the lower bound of the t-based confidence interval.

17. The electronic gaming device of claim 16, wherein the predetermined percentage confidence level is a 99% confidence level indicative of a 99% likelihood that a calculated hold percentage for any subset of wagers comprising a predetermined minimum number of wagers will be between the upper bound and the lower bound of the range of expected hold percentages.

18. The electronic gaming device of claim 16, the memory further comprising machine readable instructions that cause the processor circuit to, as part of transmitting the anomaly alert, transmit data identifying a time interval that is associated with the subset of wagers.

19. The electronic gaming device of claim 18, the memory further comprising machine readable instructions that cause the processor circuit to, in response to determining that the hold percentage of the subset of wagers is below the lower bound of the t-based confidence interval, access surveillance information associated with the subset of wagers placed during the time interval.

20. A method for detecting statistical anomalies in a wagering game comprising:

determining, by a processor circuit, wagering data for a wagering game, the wagering data comprising information representative of a plurality of wagers comprising, for each wager of the plurality of wagers, a wager amount, a wager result, and a wager payout;

calculating, by the processor circuit based on the plurality of wagers, a t-based confidence interval that defines:

a range of expected hold percentages comprising an upper bound and a lower bound; and a predetermined percentage confidence level indicative of a likelihood that a calculated hold percentage for any subset of wagers comprising a predetermined minimum number of wagers will be between the upper bound and the lower bound of the range of expected hold percentages;

defining, by the processor circuit, a subset of wagers of the plurality of wagers comprising the predetermined minimum number of wagers;

calculating, by the processor circuit, a hold percentage for the subset of wagers;

determining, by the processor circuit, whether the hold percentage for the subset of wagers is below the lower bound of the t-based confidence interval; and in response to determining that the hold percentage of the subset of wagers is below the lower bound of the t-based confidence interval, transmitting, by the processor circuit via a communication interface, an anomaly alert that is associated with the subset of wagers that causes an alert indication to be displayed to an operator to inform the operator that the hold percentage of the subset of wagers is below the lower bound of the t-based confidence interval.

* * * * *